US007596909B1

(12) United States Patent
Gillen

(10) Patent No.: US 7,596,909 B1
(45) Date of Patent: Oct. 6, 2009

(54) PREFABRICATED BUILDING HAVING A PRE-CAST CONCRETE CHAIN WALL FOUNDATION

(76) Inventor: Glenn Gillen, 4425 Wade Dr., Metairie, LA (US) 70003

( * ) Notice: Subject to any disclaimer, the term of this patent is extended or adjusted under 35 U.S.C. 154(b) by 0 days.

(21) Appl. No.: 11/622,865

(22) Filed: Jan. 12, 2007

Related U.S. Application Data

(60) Provisional application No. 60/758,384, filed on Jan. 12, 2006.

(51) Int. Cl.
*E04H 1/00* (2006.01)
*E02D 27/00* (2006.01)
*E02D 27/32* (2006.01)

(52) U.S. Cl. ..... 52/79.1; 52/292; 52/294; 52/293.1; 52/745.2; 52/122.1

(58) Field of Classification Search ..... 52/296, 52/292, 293.2, 294, 236.5, 745.2, 143, 79.1, 52/79.11, 650.1, 223.8, 223.9, 223.11, 251, 52/106, 122.1, 124.1, 125.2, 125.4, 79.3, 52/79.2
See application file for complete search history.

(56) References Cited

U.S. PATENT DOCUMENTS 2,212,757 A * 8/1940 Stout ..... 52/174
3,367,063 A * 2/1968 Bondesen et al. ..... 446/119
3,438,157 A * 4/1969 La Monica ..... 52/20
3,708,931 A * 1/1973 Button ..... 52/169.2
3,902,287 A * 9/1975 Livingston ..... 52/73
4,236,361 A * 12/1980 Boden ..... 52/204.1
4,290,246 A * 9/1981 Hilsey ..... 52/169.1
4,565,044 A * 1/1986 Takahara ..... 52/745.01
5,644,871 A * 7/1997 Cohen et al. ..... 52/125.1
5,743,065 A * 4/1998 Crews et al. ..... 52/745.05
5,860,262 A * 1/1999 Johnson ..... 52/426
5,924,264 A * 7/1999 Vierra ..... 52/741.15
6,032,421 A * 3/2000 Yamada ..... 52/79.8
6,125,597 A * 10/2000 Hoffman et al. ..... 52/169.12
6,178,714 B1 * 1/2001 Carney, Jr. ..... 52/564
6,272,810 B1 * 8/2001 Ingram et al. ..... 52/742.14
6,481,178 B2 * 11/2002 Moore, Jr. ..... 52/741.13
7,062,885 B1 * 6/2006 Dickenson, Jr. ..... 52/293.3
7,185,467 B2 * 3/2007 Marty ..... 52/425

* cited by examiner

*Primary Examiner*—Richard E Chilcot, Jr.
*Assistant Examiner*—Mark R Wendell
(74) *Attorney, Agent, or Firm*—Garvey, Smith, Nehrbass & North, L.L.C.; Charles C. Garvey, Jr.

(57) ABSTRACT

A prefabricated building includes a pre-cast concrete chain wall foundation having upper and lower walls with a height and a thickness, the ratio of wall height to wall thickness being equal to or greater than 3 to 1 and the wall height is at least three (3) feet; and a prefabricated building positioned upon the precast concrete chain wall foundation, wherein the prefabricated building has walls that rest upon the upper surface of the pre-cast concrete chain wall foundation.

15 Claims, 13 Drawing Sheets

PREFABRICATED BUILDING HAVING A PRE-CAST CONCRETE CHAIN WALL FOUNDATION

CROSS-REFERENCE TO RELATED APPLICATIONS

Priority of U.S. Provisional Patent Application Ser. No. 60/758,384, filed Jan. 12, 2006, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method of erecting a building or like structure wherein a pre-cast concrete chain wall is first constructed and then transported to a selected building site. Even more particularly, the present invention relates to an improved method of elevating a building or other structure or equipment at a lower cost and/or reduced construction time.

2. General Background of the Invention

Cast-in-place concrete chain walls are typically used to elevate buildings in flood prone areas. One of the most common usages of the chain walls are for prefabricated modular buildings used by telecommunications or other communication companies.

Each individual company normally uses a standard size building. Thus the footprint of the chain wall is normally constant. The time and construction cost for building a cast-in-place chain wall at a particular site can be extremely expensive and time consuming.

After the concrete is poured, the concrete must be allowed time to cure. The wooden forms used for cast-in-place chain walls are then removed and typically disposed of. This entire process could range from 2-4 weeks (even longer if there are delays in obtaining materials or due to weather). There are known cases in which the wooden forms have failed and the final walls are bowed out of alignment. The concrete must be delivered to the site from a concrete plant which could be several miles from the site location. The compressive strength of the cast-in-place concrete chain wall is usually determined 28 days after the concrete is poured.

The present invention provides an improved method of installing an elevated building at a particular location and in a shorter time frame. The present cast-in-place method usually requires a contractor to order wooden forms, steel reinforcing bars, concrete trucks to pour, labor to form and pour the cast-in-place chain wall, and possible pump trucks and matting.

The present invention has many advantages over the current cast-in-place type systems. The pre-cast chain wall can be poured and stored in a storage facility months prior to the beginning of a job. The forms used for the pre-cast chain wall system can be metal, which can be used many times. The concrete can be poured in ideal weather conditions and is usually supplied by an on-site concrete manufacturer. The metal forms can be specifically tooled to accept attachments for landing, tie-down plates or other attachments which are typically required by the client.

These metal forms can be built with vertical grooves or any other type of decorative pattern to make the finished product more aesthetically pleasing than the present cast-in-place chain wall.

The exterior walls for the pre-cast chain wall can be smoother and contain little to no honeycomb finishes as compared to the cast-in-place chain wall. The steel reinforcement could be ordered in large quantities and shipped to the fabrication plant. The cast-in-place concrete chain walls can be poured in one day, and then set aside for curing. The fabrication plant can stockpile these pre-cast chain walls and deliver them as needed.

When a client orders a pre-cast concrete chain wall, he will know the compression strength of his new concrete wall before it is delivered to his site. The construction time for placing a pre-cast chain wall on site can be reduced from 2-4 weeks to a week or even a day.

As with a standard cast-in-place chain wall, a foundation is needed in some cases to support the wall and building. If for example, pilings are required to support the wall and building, the pilings could be driven to a certain elevation, and then the pre-cast chain wall can be placed on top of the piles, followed by the new prefabricated modular building.

A crane large enough to place the prefabricated modular building can first be used to set the lighter pre-cast concrete chain wall in place on top of the piles. The modular building can be attached to the chain wall using tie-down plates with bolts. The pre-cast chain walls can be made such that the tie-down bolts can double as attachments for lifting the wall.

A typical size (approximate dimensions) of a chain wall is 11 feet 6 inches×20 feet×4 feet high with wall thickness of 10 inches. These dimensions will vary based on the client's need and the building or structure loads.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
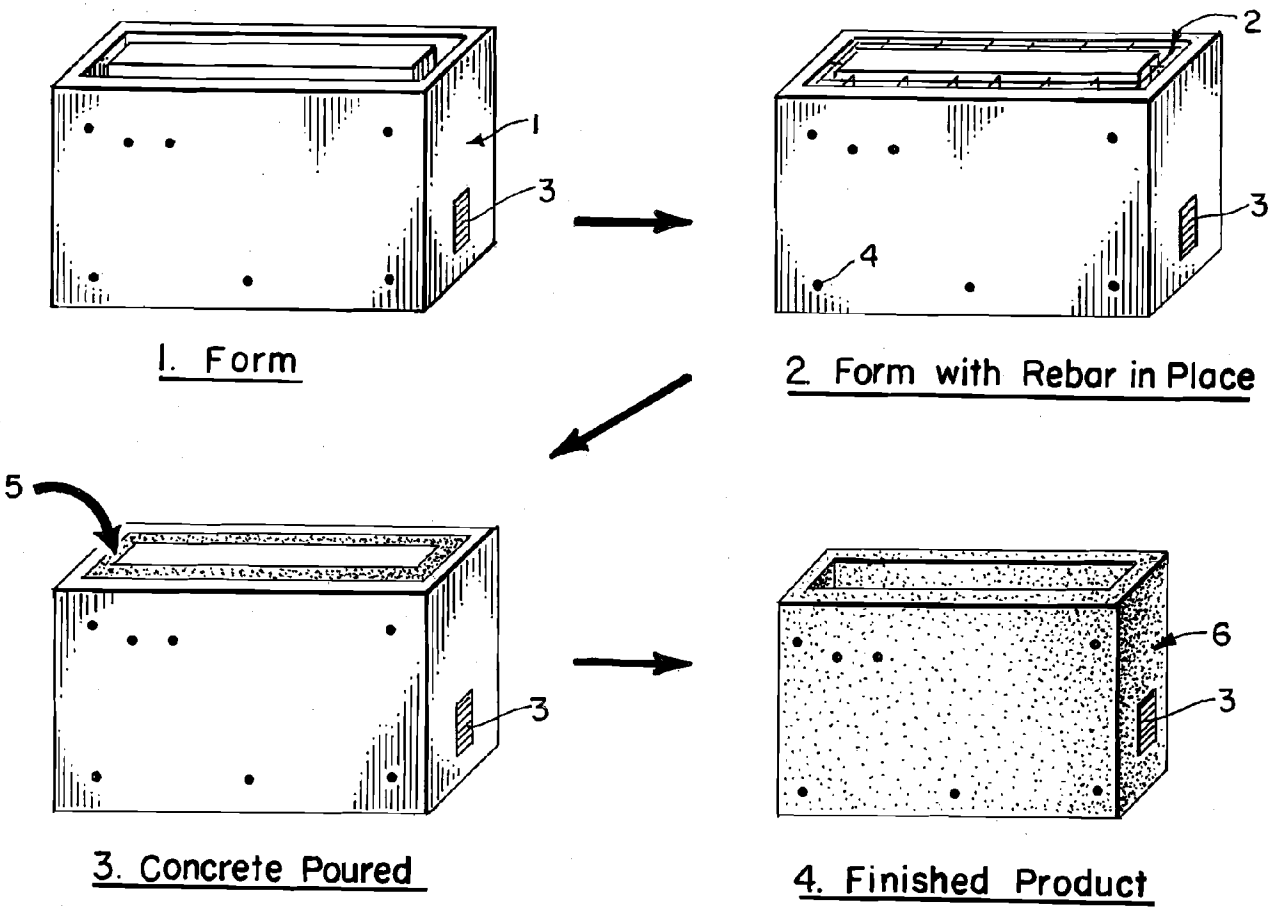
FIG. 1 is a schematic diagram illustrating method steps for forming the pre-cast concrete chain wall of the present invention.

FIG. 1 illustrates the sequence of manufacturing a finished pre-cast concrete chain wall, designated generally by the numeral 6 in FIG. 1. In order to form the finished pre-cast concrete chain wall of FIG. 1 that is designated generally by the numeral 6, a user starts with a form 1 of metal, wood, or the like, that is fitted with a steel reinforcing cage 2 or like reinforcing. An optional louver 3 can be placed in form 1 for providing access under a featured building or for allowing water flow. Inserts 4 can be provided to accept bolts or tie downs, a landing, stairs, or the like. The arrow 5 in FIG. 1 illustrates the pouring of any selected (e.g. commercially available) slurried concrete into the form 1. FIG. 1 also shows the finished pre-cast chain wall product number 6 after removal from the form 1.

Figure 3:
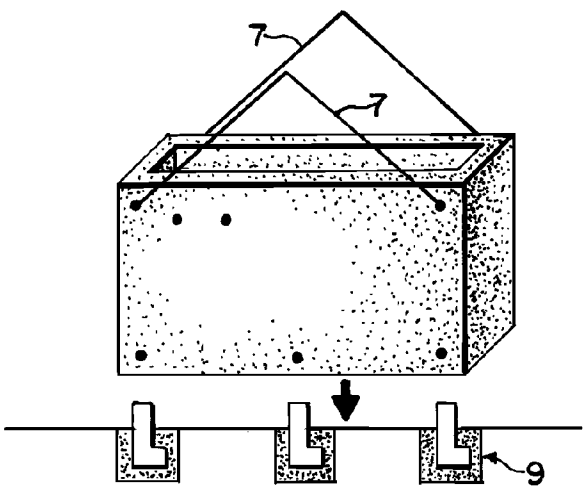
FIG. 3 is a schematic perspective view illustrating placement of the pre-cast concrete chain wall of the present invention upon an optional concrete footing foundation.
Figure 2:
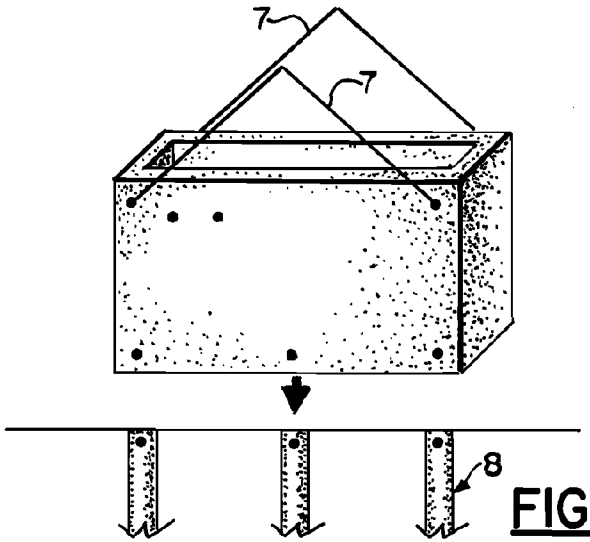
FIG. 2 is a schematic diagram illustrating a lifting of the pre-cast concrete chain wall of the present invention with lifting cables and placing it upon an optional piling foundation.
Figure 5:
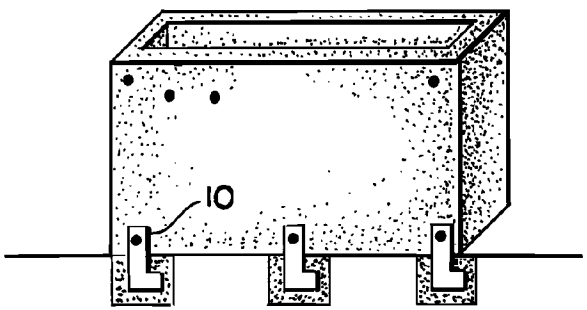
FIG. 5 is a perspective schematic view illustrating the use of tie down plates for holding the pre-cast concrete chain wall of the present invention to a foundation of concrete footings.
Figure 4:
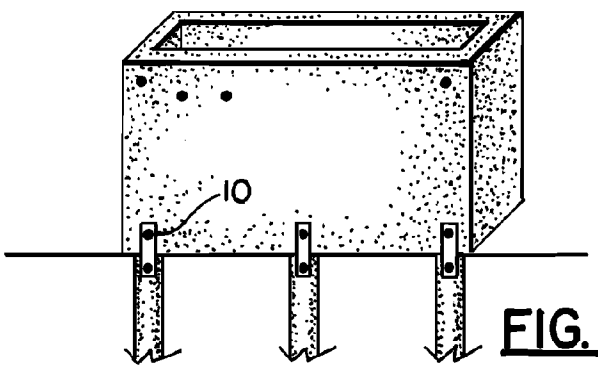
FIG. 4 is a schematic diagram of the preferred method of the present invention showing the pre-cast concrete chain wall placed upon a piling foundation and with tie down plates in position.
Figure 6:
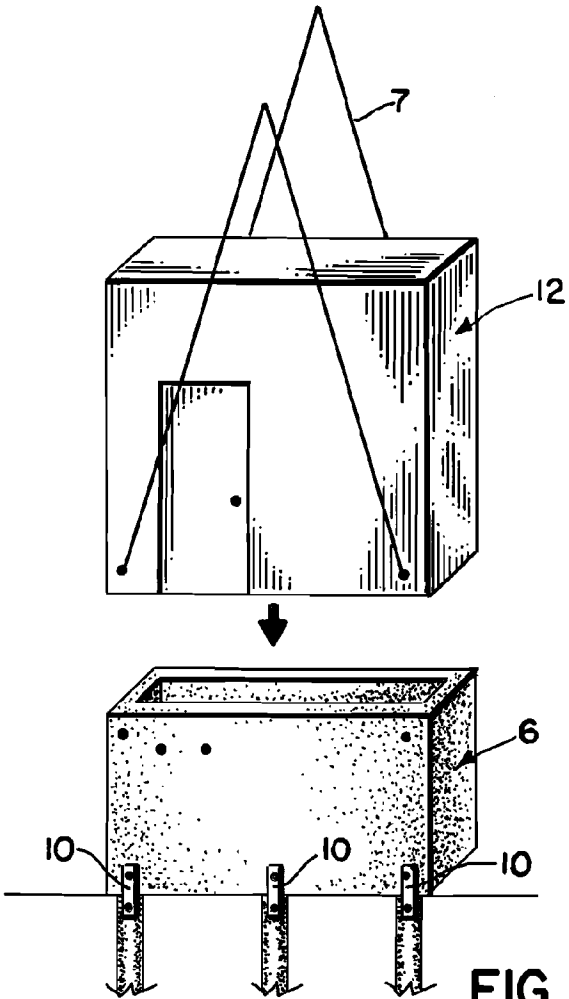
FIG. 6 is a perspective view illustrating placement of a building or like structure upon the pre-cast concrete chain wall of the present invention when support with an optional piling foundation.

In FIGS. 2 and 3, the pre-cast concrete chain wall 6 has been rigged with lifting cables 7, such rigging in combination with a lifting device (e.g. crane) is used to set the chain wall 6. Cables 7 can be rigged to building 12 or other selected structure such as a generator or prefabricated cabinet (see FIGS. 6 and 7). Once the cables 7 are used to set the pre-cast concrete chain wall 6, a selected structure 12 such as a modular building is placed upon the chain wall 6 as shown in FIG. 6.

Figure 7:
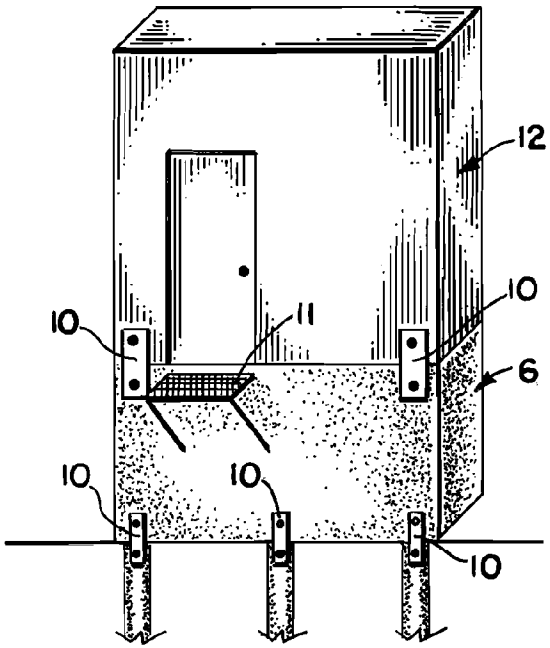
FIG. 7 is a perspective view of a first embodiment of the apparatus of the present invention.

The completed combination of building 12, pre-cast concrete chain wall 6, and optional foundation 8 or 9 can be seen in FIG. 7. Tie down plates 10 can be used to secure the building 12 to the pre-cast concrete chain wall 6. Similar tie down plates 10 can be used to secure the chain wall to the optional foundation 8 or 9.

Figure 18:
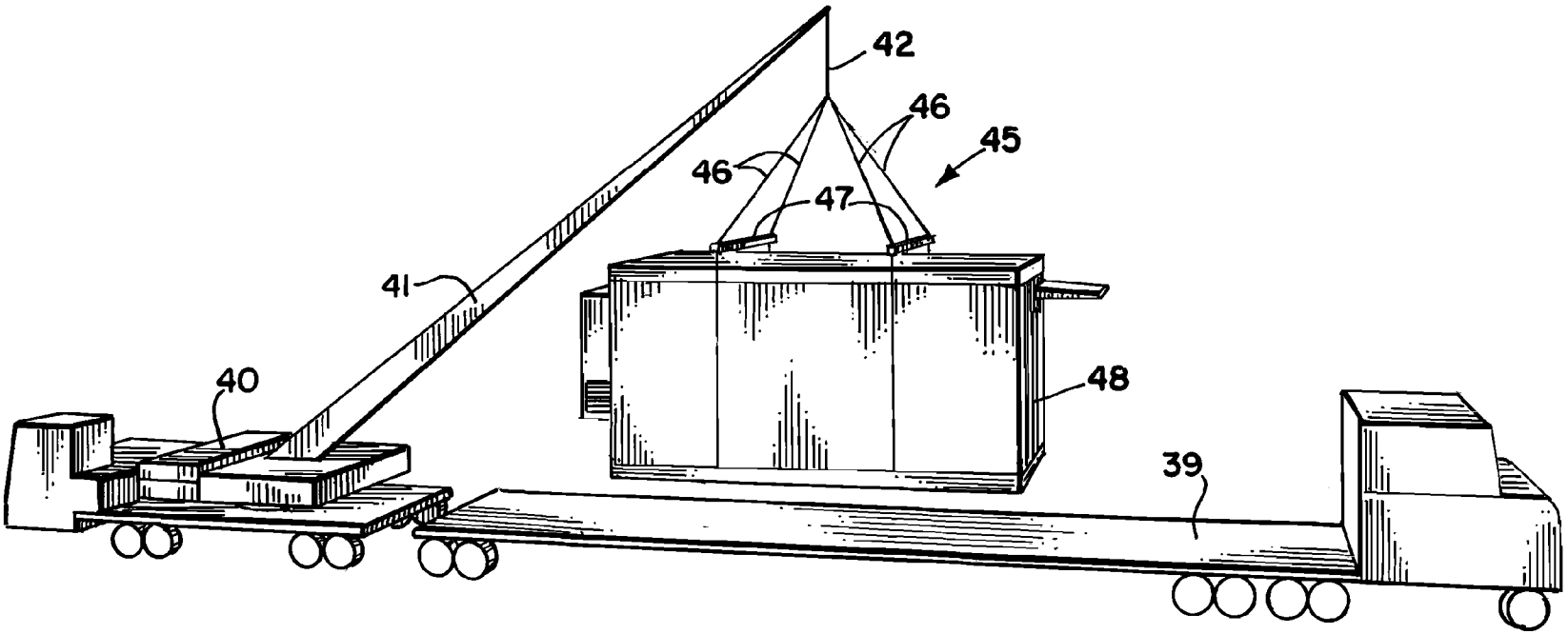
FIG. 18 is a perspective view showing another method step of the present invention, lifting building.
Figure 19:
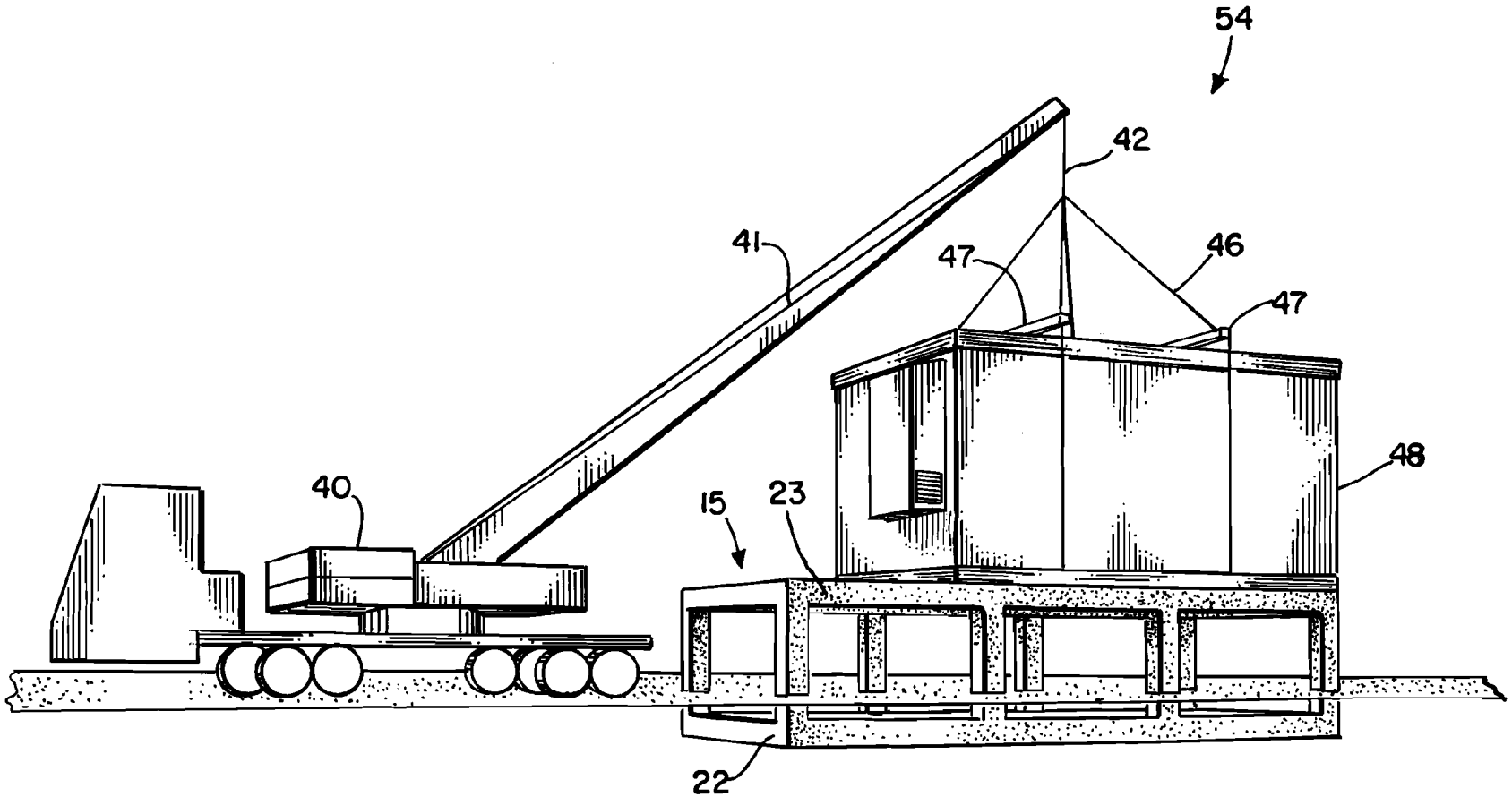
FIG. 19 is a perspective view showing another method step of the present invention, placing building on chain wall.

FIGS. 8-20 show a second embodiment of the apparatus of the present invention designated generally by the numeral 54 in FIG. 19. Second embodiment 54 includes a prefabricated building 48 and a pre-cast chain wall foundation 15. Prefabricated building as used herein includes prefabricated cabinets and generators. Both are transported to a building site 16, each using a transport vehicle 39. In FIGS. 8-14, pre-cast chain wall foundation 15 has an upper end portion 23 and a lower end portion 22. At about the time that the transport vehicle 39 transports pre-cast chain wall foundation 15 to building site 16, a trench or excavation 18 is prepared at building site 16 so that the excavation or trench 18 can receive pre-cast chain wall foundation 15 in a leveled position.

Figure 15:
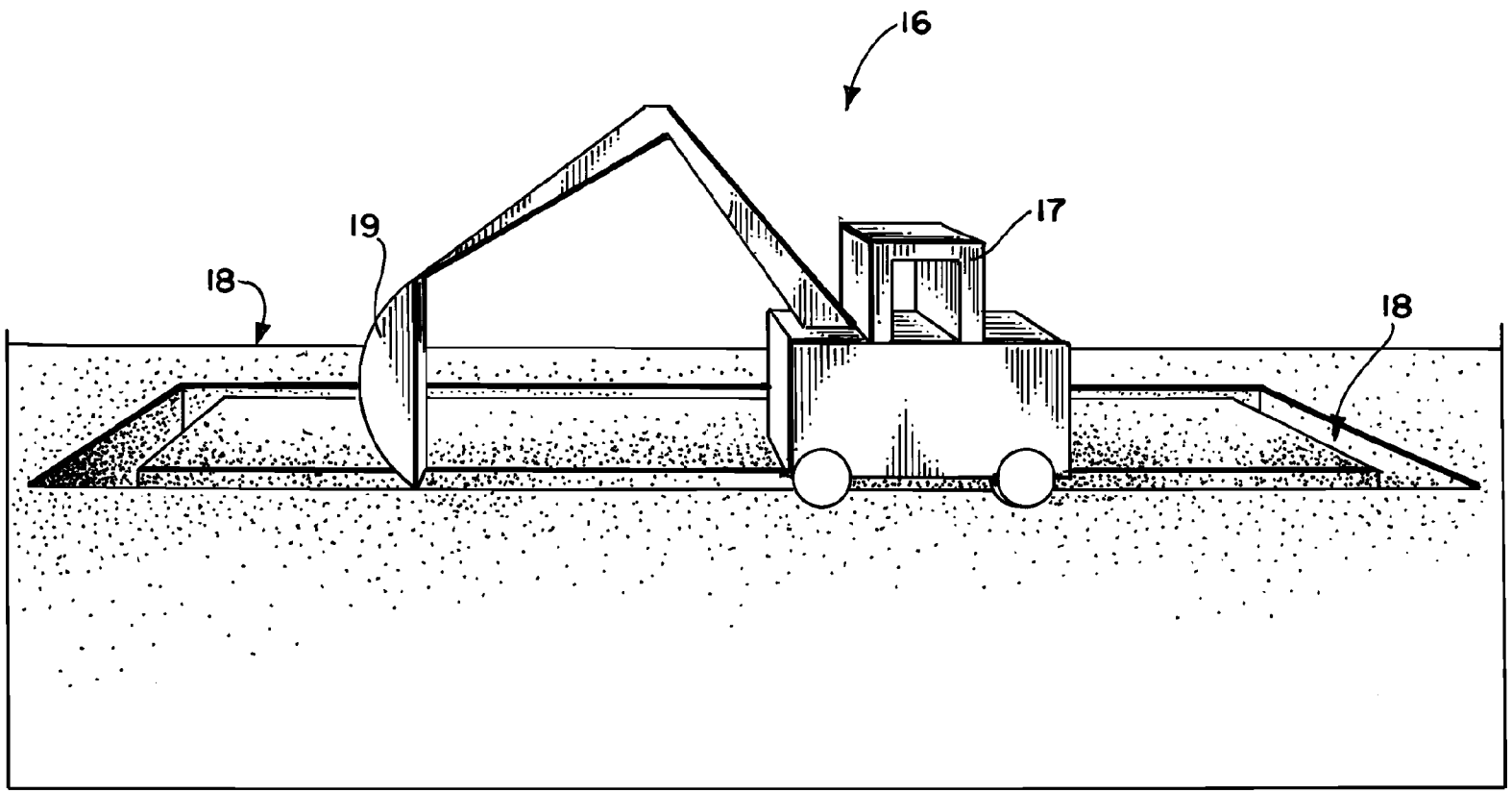
FIG. 15 is a fragmentary view illustrating part of the method of the present invention, preparing foundation.
Figure 20:
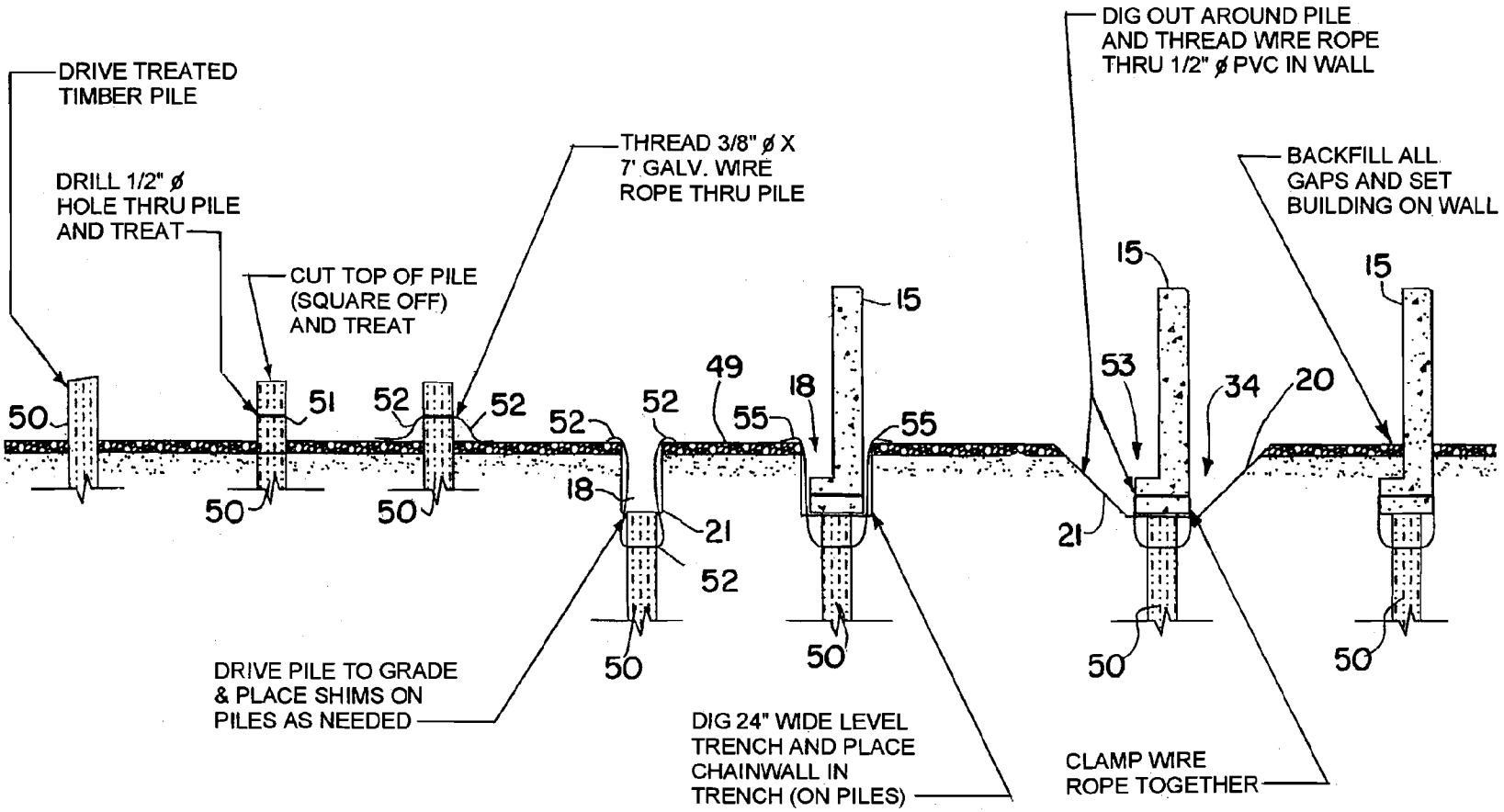
FIG. 20 is a schematic diagram illustrating the optional pre-cast chain wall to piling tie-down detail.

In FIG. 15, an excavator 17 having a bucket or other digging implement 19 is shown digging an excavation 18 or trench. In FIG. 20, the excavation or trench 18 preferably provides a bottom 21 that is level or horizontal. The trench or excavation 18 can also provide one or more sidewalls 20.

Figure 8:
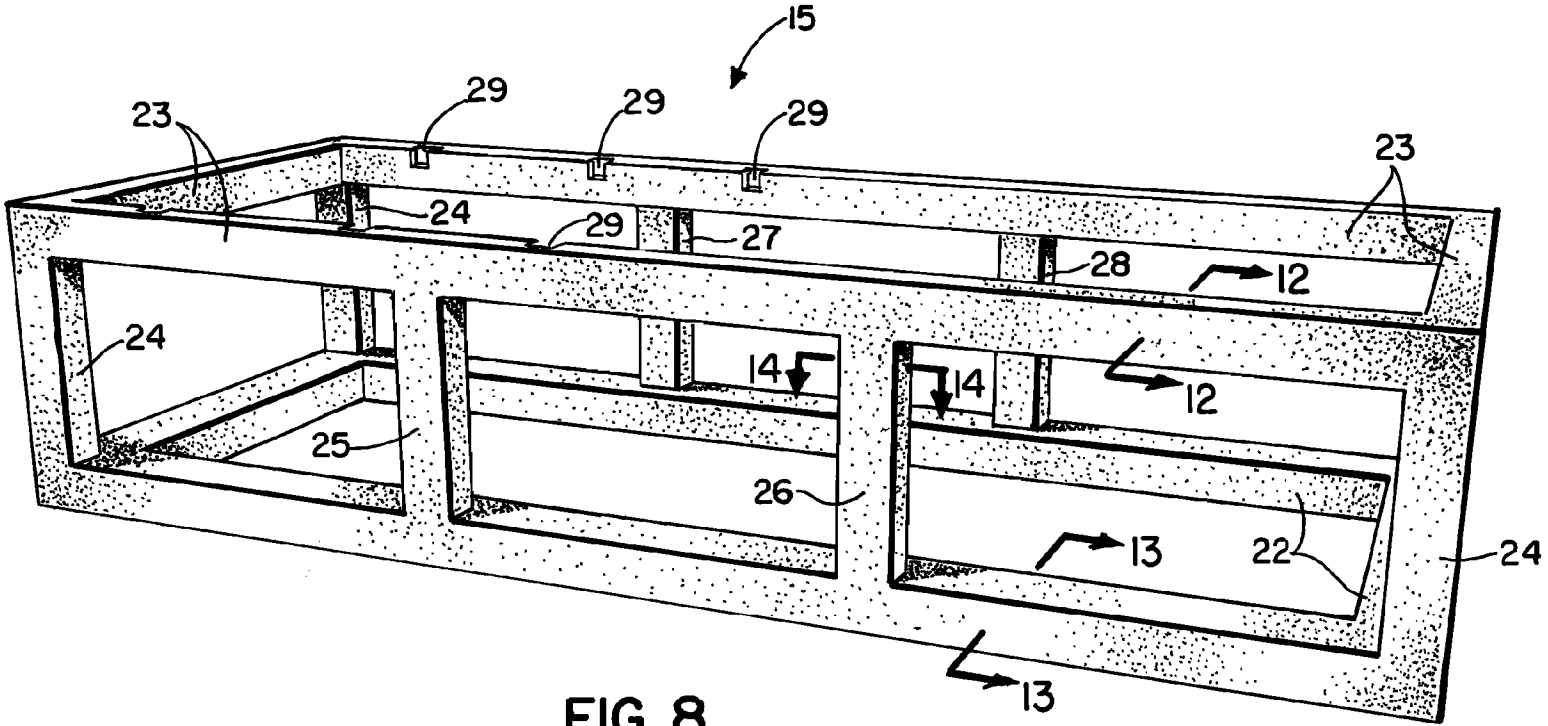
FIG. 8 is a partial perspective view of a second embodiment of the apparatus of the present invention.
Figure 9:
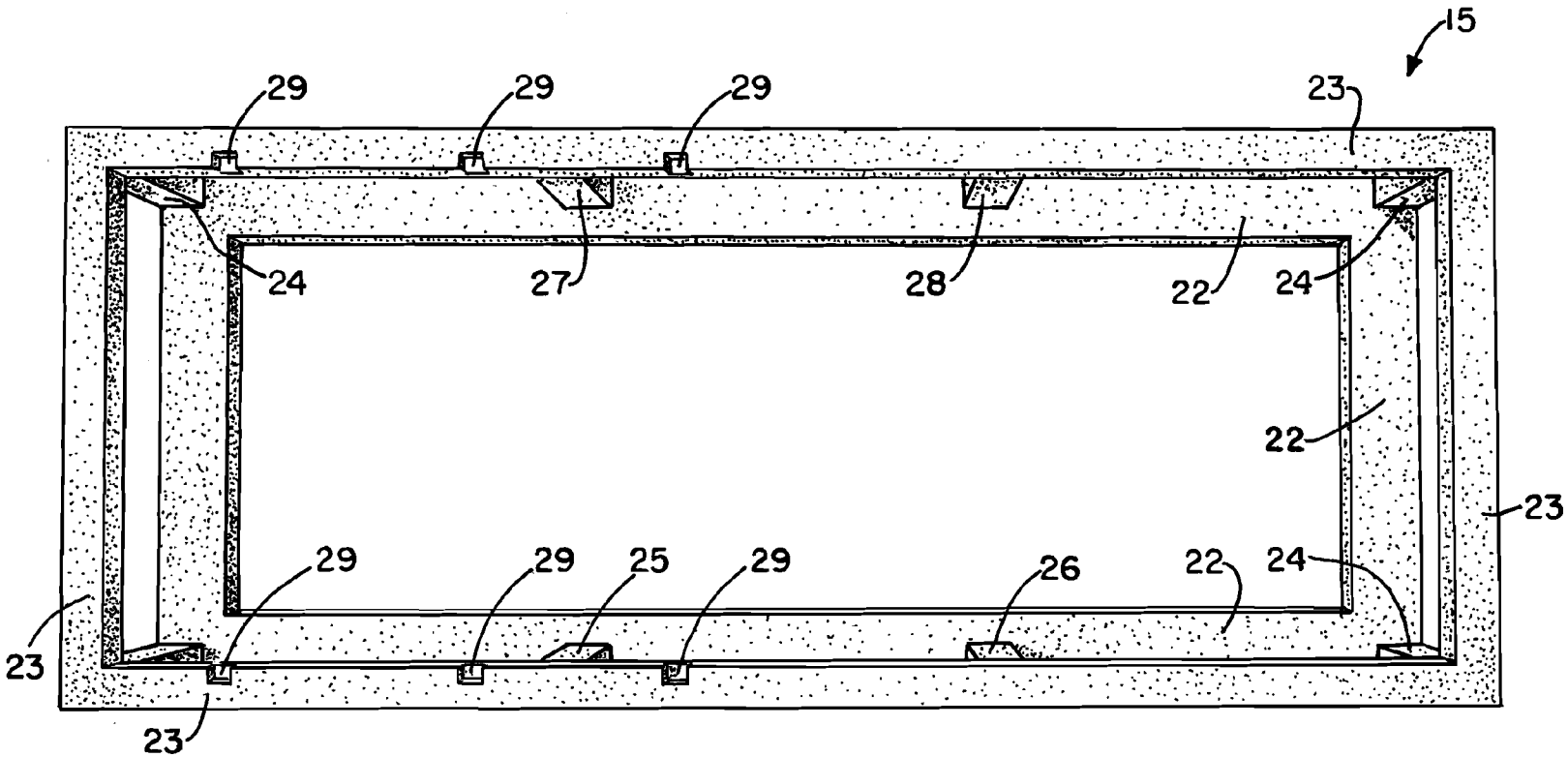
FIG. 9 is a plan view of the second embodiment of the apparatus of the present invention.
Figure 10:
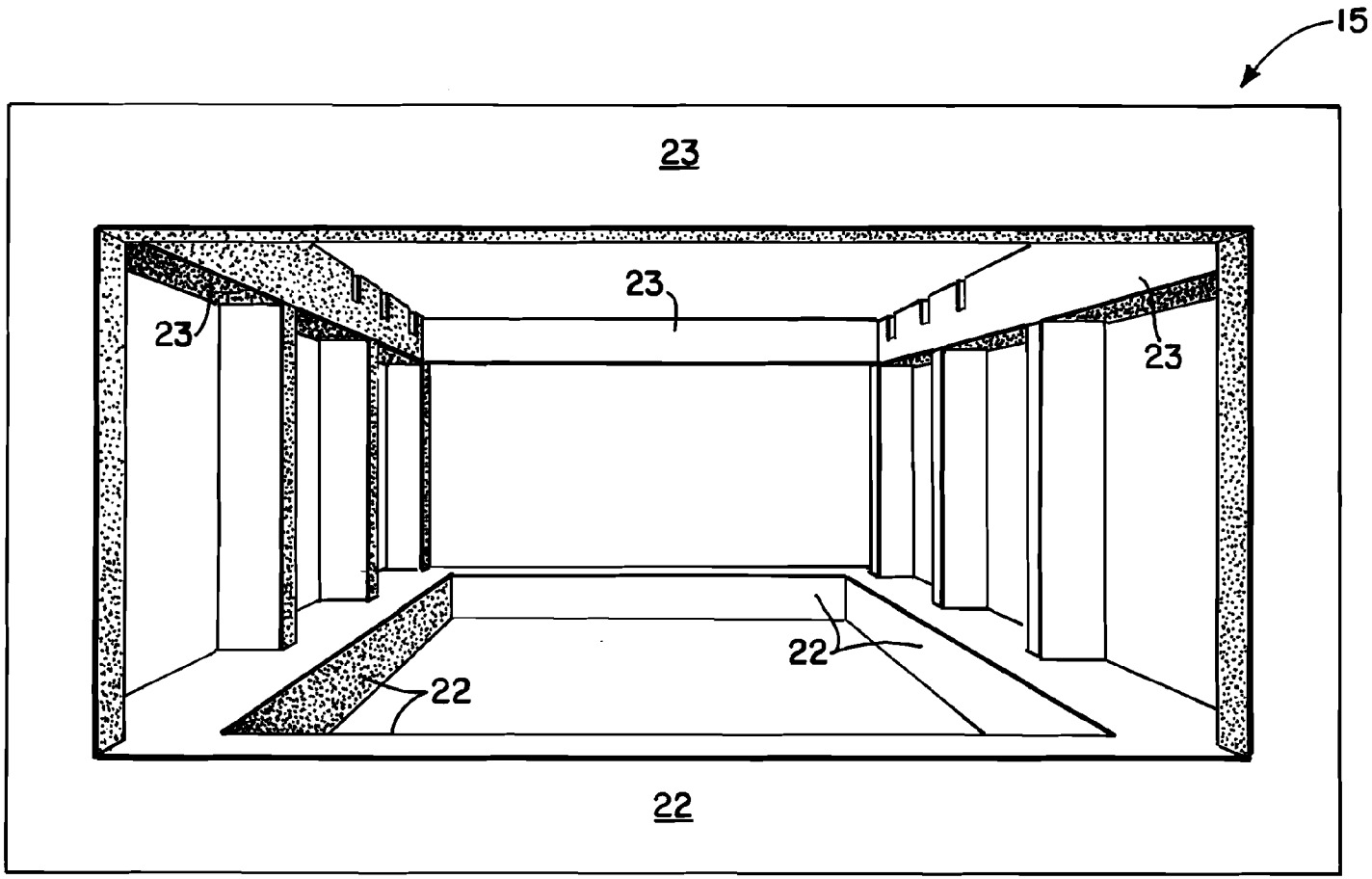
FIG. 10 is a partial perspective side view of the second embodiment of the apparatus of the present invention.

Pre-cast chain wall foundation 15 can include a number of columns 24-28. These columns include corner columns 24 and intermediate columns 25, 26, 27, 28 as shown in FIG. 8. The upper end portion 23 of pre-cast chain wall foundation 15 provides a plurality of upper beams 30 and a plurality of lower beams 33. Each of the columns 24-28 extends between an upper beam 30 and a lower beam 33 as shown.

Figure 13:
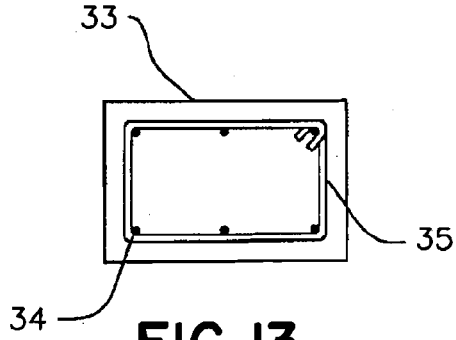
FIG. 13 is a sectional view taken along lines 13-13 of FIG. 8.
Figure 14:
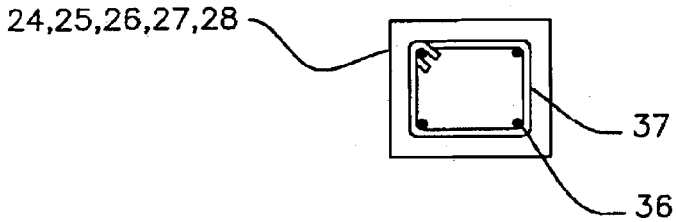
FIG. 14 is a sectional view taken along lines 14-14 of FIG. 8.

The upper beam 30 can include longitudinal reinforcing bars 31 or rebars and spaced stirrups 32. In FIG. 13, the lower beam or foundation beam 33 includes longitudinally extending reinforcing bars or rebars 34 and laterally spaced apart stirrups 35. Likewise, each column 24-28 can be provided with vertical reinforcing bars or rebars 36 and vertically spaced apart stirrups 37.

The upper beam 30 can include optional notches 29 as shown in FIG. 8 to be used for support beams (e.g. wide flanged beams, I-beams, channel beams, etc.) for possible walkways, equipment such as generators and outside cabinets, or prefabricated building requiring additional support.

Figure 11:
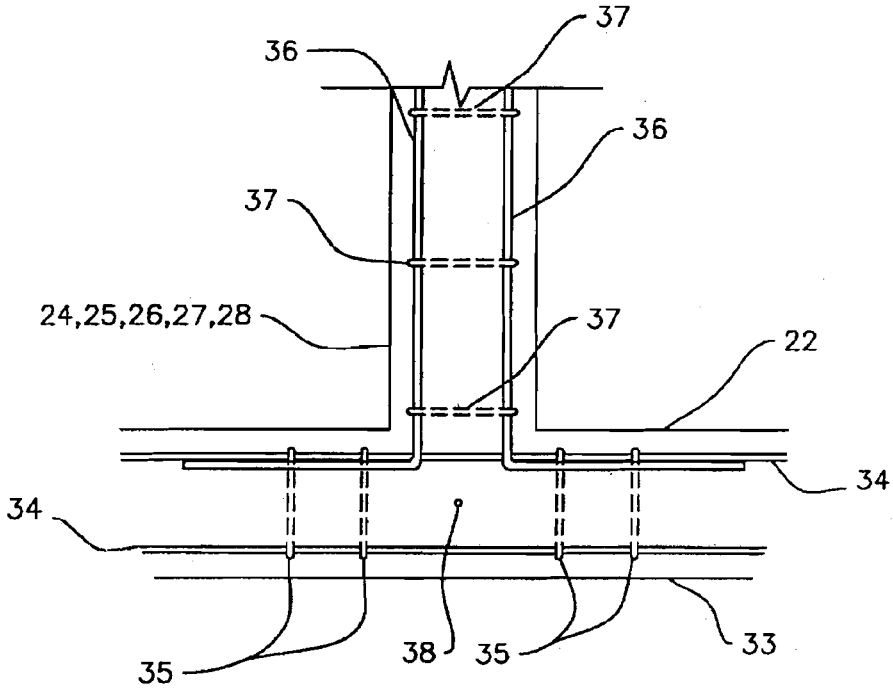
FIG. 11 is a fragmentary elevation view of the second embodiment of the apparatus of the present invention.
Figure 12:
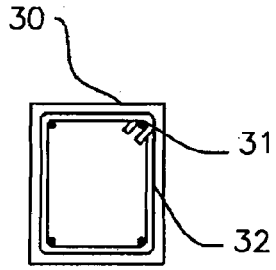
FIG. 12 is a sectional view taken along lines 12-12 of FIG. 8.

One or more plastic tubing sections 38 is provided at numerous locations on pre-cast chain wall foundation such as for example at the lower end portion of a column 24-28 as shown in FIG. 11. Each plastic tubing 38 can be a bore or passageway that extends through the pre-cast chain wall foundation 15 for enabling a steel cable or other connective strap to be inserted for optionally forming a tie between pre-cast chain wall foundation 15 and each of a number of piling 50 (see FIG. 20).

Figure 16:
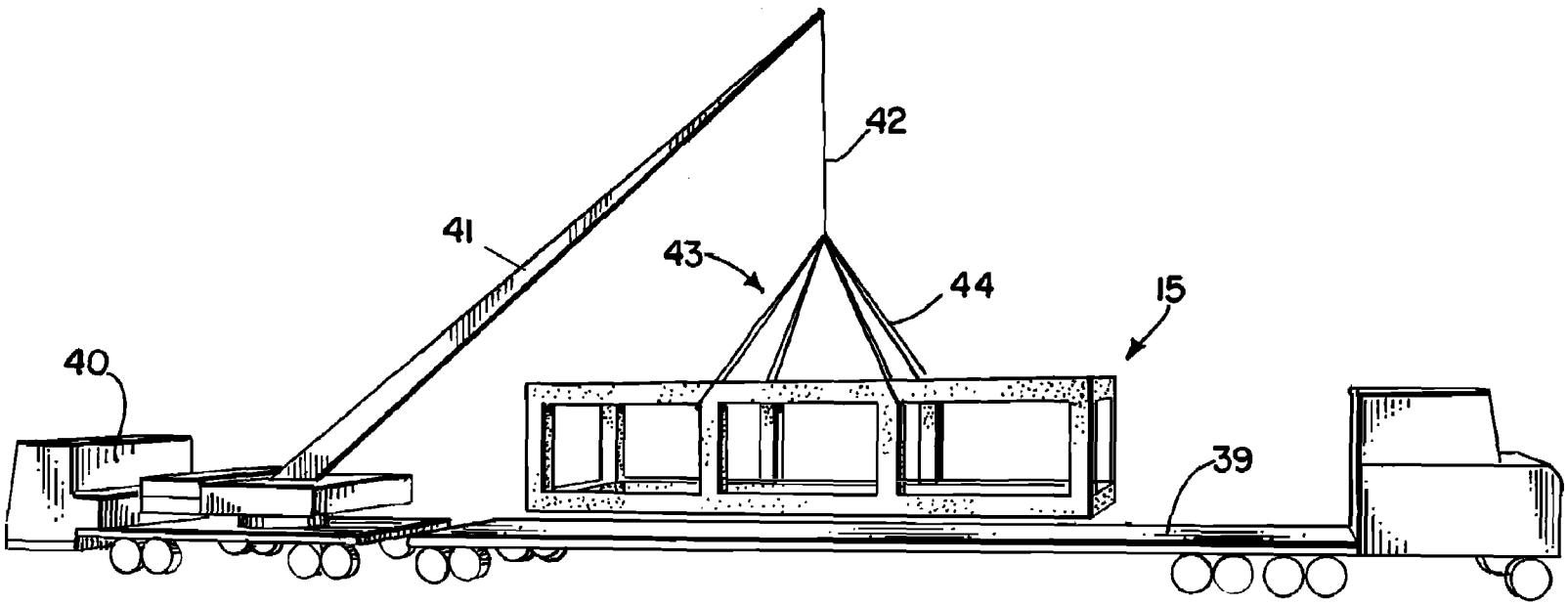
FIG. 16 is a perspective view showing another step of the method of the present invention, lifting chain wall.

When the pre-cast chain wall foundation 15 is transported to building site 16 using transport vehicle 39, a lifting device 40 or like mechanism is employed to transfer pre-cast chain wall foundation 15 from transport vehicle 39 to the trench or excavation 18 at building site 16. FIG. 16 illustrates a lifting of pre-cast chain wall foundation 15 with a truck crane 40 or other lifting device having a boom 41 and lifting line or crane line 42. Rigging 43 can be employed to form an interface between the crane or lifting line 42 and pre-cast chain wall foundation 15. Such rigging 43 can include a plurality of slings 44 that are wrapped around the upper end portion 23 of pre-cast chain wall foundation 15 as shown in FIG. 16.

Figure 17:
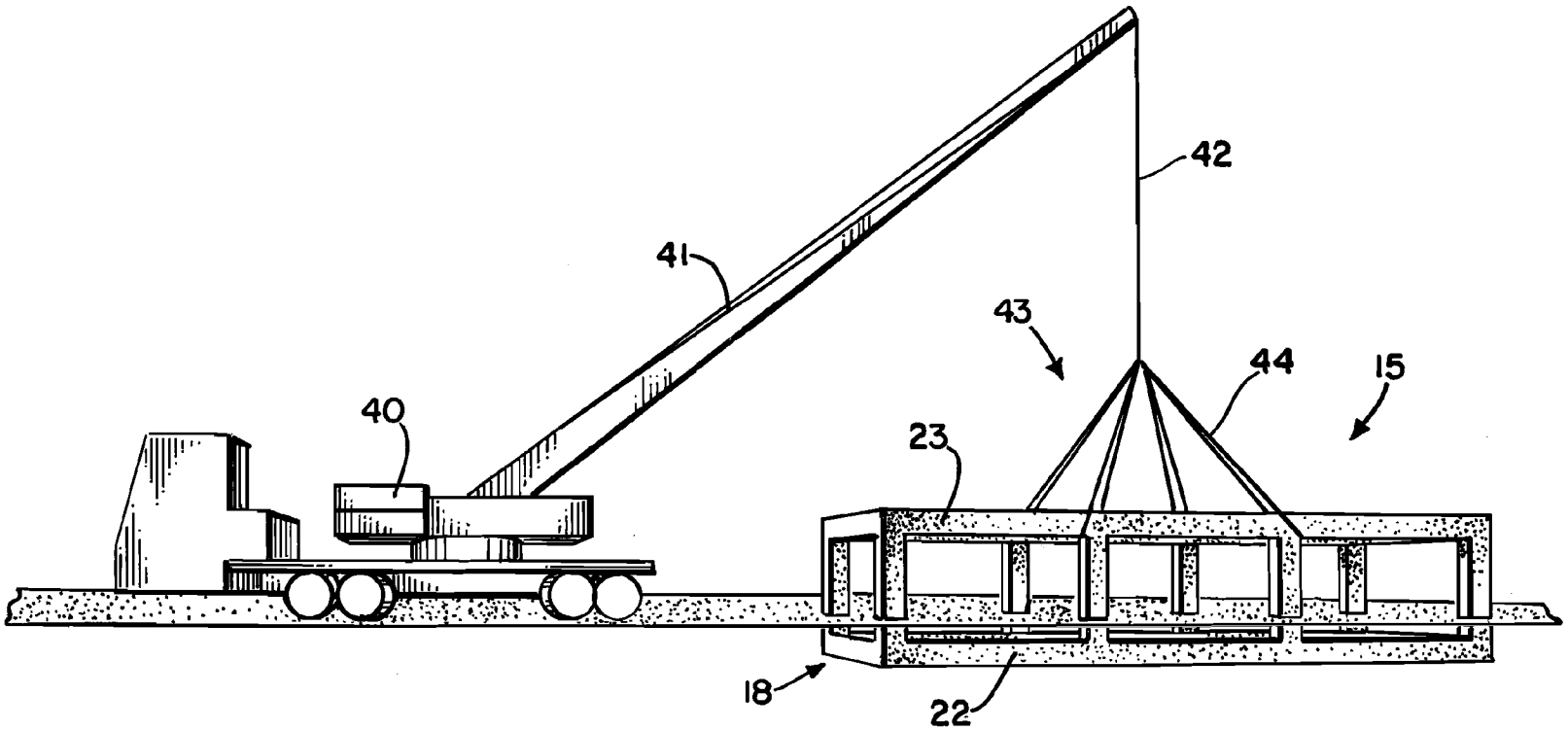
FIG. 17 is a perspective view showing another method step of the present invention, placing chain wall on prepared foundation.

In FIG. 17, lifting device 40 has placed pre-cast chain wall foundation 15 in trench or excavation 18 wherein pre-cast chain wall foundation rests upon the bottom 21 of excavation or trench 18.

A prefabricated building 48 or other building can be transported to building site 16 using a transport vehicle 39. A lifting device such as truck crane 40 or other device can be used to transfer building 48 to pre-cast chain wall foundation 15. In FIG. 18, the lifting line 42 interfaces with rigging 45 that can include slings 46 and optional spreader bars 47. In FIGS. 19-20, pre-cast chain wall foundation 15 extends below the earth's surface 49 and rests upon the bottom 21 of excavation or trench 18.

A plurality of piling such as treated timber piles 50 can optionally be used as part of a tie-down arrangement as shown in FIG. 20. As used herein, piling includes any known installed piling such as but not limited to footings, concrete or timber piling, screw piling, cast in place concrete pile, composite pile, or the like. In FIG. 20, a pile 50 such as a treated timber pile is driven a partial distance into the earth and below earth's surface 49. The pile 50 is then cut if required to provide a level surface, and can be a treated pile, if necessary.

An opening or channel 51 is formed through the upper end portion of pile 50. A galvanized wire rope 52 or other tie is inserted through channel or opening 51 leaving end portions 55 of galvanized wire rope or tie 52 exposed so that a tie can be formed between the end portions 55 and pre-cast chain wall foundation 15. Pile 50 is then driven a further distance into the earth until its upper end is about even with the elevation of the bottom 21 of trench or excavation 18. Shims can be placed on each pile 50 as needed. The trench or excavation 18 is then preferably widened for enabling a user to form a connection between end portions 55 and chain wall foundation 15. The enlarged excavation 53 is simply an enlargement of the trench or excavation 18 at each pile location. The wire rope 52 is then threaded through plastic tubing 38 or channel formed through pre-cast chain wall foundation 15. The wire rope 52 is then clamped or fastened together to form a tie between each piling 50 and pre-cast chain wall foundation 15, each can be at a position below a column 24-28.

The present invention provides an improved business method that enables a contractor or vendor to offer a pre-cast building to a customer for delivery in a very short period of time. Because the pre-cast chain wall foundation 15 is a pre-cast prefabricated structure, it can be transported to a job site in a very short period of time such as for example in less than a week or in less than a day. Similarly, building 48 can be a prefabricated building that can be transported using a transport vehicle 39. The building 48 can be transported in a short period of time such as in less than a week or in less than a day to a selected job site or building site 16. Using the business method of the present invention, the customer can be offered a building 48 and foundation 15 than can be erected in less than a week or even less than a day. Such a customer can also be offered a pre-cast chain wall foundation 15 that is already constructed and available for inspection before it is ever installed.

The following is a list of parts and materials suitable for use in the present invention.

PARTS LIST

| Part Number | Description |
|---|---|
| 1 | metal form for new pre-cast concrete chain wall |
| 2 | steel reinforcing cage |
| 3 | optional louver to provide access under future building, or allow water flow |
| 4 | inserts to accept bolts for tie-downs, landing, etc. |
| 5 | concrete to be poured into form |
| 6 | finished pre-cast chain wall |
| 7 | cables to set chain wall and building |
| 8 | optional piling foundation |
| 9 | optional concrete footing foundation |
| 10 | tie down plates |
| 11 | optional landing |
| 12 | building or other structure |
| 15 | pre-cast chain wall foundation |
| 16 | building site |
| 17 | excavator |
| 18 | trench or excavation |

-continued

PARTS LIST

| Part Number | Description |
|---|---|
| 19 | bucket |
| 20 | side wall of excavation (trench) |
| 21 | bottom of excavation (trench) |
| 22 | lower end portion |
| 23 | upper end portion |
| 24 | corner column |
| 25 | column |
| 26 | column |
| 27 | column |
| 28 | column |
| 29 | notches (5"-6" deep) |
| 30 | upper beam |
| 31 | longitudinal reinforcing bar |
| 32 | stirrup |
| 33 | lower beam |
| 34 | longitudinal reinforcing bar |
| 35 | stirrup |
| 36 | vertical reinforcing bar |
| 37 | stirrup |
| 38 | plastic tubing or channel |
| 39 | transport vehicle |
| 40 | lifting device |
| 41 | boom |
| 42 | crane line |
| 43 | rigging |
| 44 | sling |
| 45 | rigging |
| 46 | sling |
| 47 | spreader bar |
| 48 | prefabricated building |
| 49 | earth's surface |
| 50 | treated timber pile |
| 51 | opening or channel |
| 52 | galvanized wire ropes |
| 53 | enlarged excavation |
| 54 | second embodiment of the present invention |
| 55 | end portion |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A prefabricated building, comprising:

a) a pre-cast concrete chain wall foundation having upper and lower surfaces and walls with a height and a thickness, the ratio of wall height to wall thickness being equal to or greater than 3 to 1 and the wall height is at least three (3) feet, wherein the precast concrete chain wall foundation includes a plurality of corner columns that are integral poured corners not joined by external fasteners, a plurality of intermediate columns, upper and lower spaced apart beams and a plurality of openings that are surrounded by upper and lower beams and columns, and wherein said pre-cast concrete chain wall foundation is not a poured in place foundation;

b) a prefabricated building positioned upon the upper surface of the precast concrete chain wall foundation, c) wherein the prefabricated building has walls that rest upon the upper surface of the pre-cast concrete chain wall foundation.

2. The prefabricated building of claim 1 wherein the chain wall foundation has upper notches and beams that span between notches.

3. The prefabricated building of claim 1 wherein the chain wall foundation has corner columns, intermediate columns and openings in between intermediate and corner columns.

4. The prefabricated building of claim 1 wherein the pre-cast chain wall is a one piece structure.

5. The prefabricated building of claim 1 wherein the pre-cast chain wall has a continuous outer wall joined at corners.

6. The prefabricated building of claim 1 further comprising a second building positioned upon the chain wall foundation.

7. The prefabricated building of claim 1 further comprising openings in the pre-cast concrete chain wall foundation, piling supporting the pre-cast concrete chain wall foundation and ties that join the pre-cast concrete chain wall foundation to the piling.

8. The prefabricated building of claim 1 further comprising one or more footings placed under the precast concrete chain wall foundation.

9. A prefabricated building installation system for installing a building and foundation upon a selected site, comprising:

a) a lifting device;

b) a prefabricated concrete chain wall foundation having multiple planar wall sections and multiple corners, each wall section having a wall height and a wall thickness, the ratio of the wall height to wall thickness being at least 3 to 1, wherein the precast concrete chain wall foundation includes a plurality of corner columns that are integral poured corners not joined by external fasteners, a plurality of intermediate columns, upper and lower spaced apart beams and a plurality of openings that are surrounded by upper and lower beams and columns, and wherein said pre-cast concrete chain wall foundation is not a poured in place foundation;

c) a prefabricated building having a floor, walls, ceiling and roof;

d) at least one transporting vehicle that enables transport of the lifting device and the prefabricated concrete chain wall foundation to a selected building site;

e) rigging that enables the lifting device to transfer the prefabricated concrete chain wall foundation to the selected site and for transfer of the prefabricated building from the transporting vehicle and placement upon the prefabricated concrete chain wall foundation; and f) the prefabricated concrete chain wall foundation and prefabricated building occupying the selected site which is defined by the positioning generated by the lifting device.

10. The prefabricated building installation system of claim 9 wherein the concrete chain wall foundation weighs between about 8,000 and 60,000 pounds.

11. The prefabricated building installation system of claim 6 wherein the second building is a cabinet.

12. The prefabricated building installation system of claim 1 wherein the prefabricated building is a cabinet.

13. The prefabricated building installation system of claim 1 further comprising notches on the chain wall foundation and beams that span between the notches.

14. The prefabricated building installation system of claim 13 wherein the chain wall foundation is a multiple wall structure that includes one wall section having a wall section area and an opening having an opening area that is at least one half of the wall section area.

15. The prefabricated building installation system of claim 9 wherein each wall section has a wall section area and the opening of each wall section has an opening area that is at least one half of the wall section area that has the opening.

* * * * *